US005984553A

United States Patent [19]

Piscopo et al.

[11] Patent Number: 5,984,553

[45] Date of Patent: *Nov. 16, 1999

[54] DISPENSER-APPLICATOR

[75] Inventors: Peter Piscopo, Medford, N.J.; Richard H. Seager, Mystic, Conn.

[73] Assignee: The Plastek Group, Erie, Pa.

[ * ] Notice: This patent is subject to a terminal disclaimer.

[21] Appl. No.: 09/144,187

[22] Filed: Aug. 31, 1998

Related U.S. Application Data

[63] Continuation of application No. 08/728,067, Oct. 9, 1996, Pat. No. 5,800,086.

[51] Int. Cl.[6] ..... A45D 40/02

[52] U.S. Cl. ..... 401/82; 401/84

[58] Field of Search ..... 401/176, 82, 83, 401/84, 55; 222/391, 386

[56] References Cited

U.S. PATENT DOCUMENTS

| | | | |
|---|---|---|---|
| 1,027,127 | 5/1912 | Harvey | 401/176 |
| 1,494,736 | 5/1924 | Cottrell | 401/83 |
| 2,642,606 | 6/1953 | Aschenbach | 401/176 |
| 3,443,874 | 5/1969 | Pelli et al. | 401/82 |
| 4,298,036 | 11/1981 | Horvath | 401/55 X |
| 4,621,935 | 11/1986 | Sussman | 401/82 |
| 4,630,953 | 12/1986 | Cabral et al. | 401/84 X |
| 5,167,462 | 12/1992 | Lucas | 401/82 |
| 5,356,037 | 10/1994 | Harbold . | |
| 5,421,663 | 6/1995 | Bravo . | |
| 5,800,086 | 9/1998 | Poscopo et al. | 401/82 |

FOREIGN PATENT DOCUMENTS

| | | | |
|---|---|---|---|
| 457452 | 11/1991 | European Pat. Off. | 222/391 |
| 1075553 | 2/1960 | Germany | 401/176 |
| 441042 | 10/1948 | Italy | 401/82 |
| 9001006 | 2/1990 | WIPO | 401/176 |

*Primary Examiner*—Steven A. Bratlie
*Attorney, Agent, or Firm*—Bachman & Lapointe, P.C.

[57] ABSTRACT

A dispenser-applicator having an elevator for advancing product disposed within a housing having opposed, through sidewall slots. The slots are formed with ratchets and the elevator is actuated by a driver extending through and guided by said slots. The driver is formed with pawls which engage the ratchets so that the elevator can be indexed manually in step by step fashion.

6 Claims, 2 Drawing Sheets

DISPENSER-APPLICATOR

CROSS-REFERENCE TO RELATED APPLICATION

This application is a continuation of U.S. patent application Ser. No. 08/728,067, filed Oct. 9, 1996, now U.S. Pat. No. 5,800,086.

BACKGROUND OF THE INVENTION

The present invention relates to a dispenser-applicator. That is, a unit containing solid or semi-solid product where the product is advanced incrementally for subsequent application to a surface.

While the invention is not so limited a typical product may include deodorants, anti-perspirants, depilatories and the like.

SUMMARY OF THE INVENTION

The invention embraces a structure for advancing a product in step by step fashion using a novel arrangement of a ratchet and pawl system.

The invention relates as well to a novel method of loading and molding a product where the product is heated initially to render it pourable. Thereafter the product is chilled within its container to assume a solid or semi-solid state.

A further feature of the invention is the provision of a closure assembly which includes a first disposable closure utilized as a mold and a second closure serving as an outer cap which is removable to expose the product for use and replaceable to protect the product when not in use.

One aspect of the invention involves a hollow barrel or housing containing a product elevator where the sidewall of the barrel is formed with opposed through slots formed with linear ratchets. The elevator is actuated manually by a driver having pawls which engage the ratchets. Portions of the driver project through the slots terminating in tabs which when engaged manually are operable to index the driver and thus the elevator to advance product in step by step fashion.

The elevator is supported by a tubular member which also serves as a product fill tube.

In addition, the driver acts, after filling, as a closure for the fill tube and a closure for the bottom of the barrel.

The method aspects of the invention involve providing a product which is pourable when heated and sets up or gels into a solid or semi-solid condition when cooled.

The upper end (applicator end) of the barrel is fitted with a disposable closure which serves as a mold, usually configured to create a dome shape. The barrel is then positioned (inverted) to expose the tubular fill member providing a conduit leading to the elevator.

Pourable product, heated to a temperature ranging from 120 to 150° F., is introduced in the tubular fill member loading the elevator and filling the barrel including the disposable mold.

Next the product is chilled to a temperature ranging from 38 to 45° F. causing the product to set up or gel.

Thereafter the driver is snapped in place closing the tubular fill member and the bottom of the barrel with the driver pawls engaging the ratchets.

The outer cap is applied and the unit is now in condition for utilization by the user.

The user upon receipt of the loaded dispenser-applicator places the unit in operation by removing the second closure (outer cap) and discarding the first disposable closure thereby exposing the product for use.

The product is then ready for application and as the product is diminished by use, the driver tabs are grasped and are manually operable to move product outwardly into a useful position in step by step fashion as necessary.

BRIEF DESCRIPTION OF THE DRAWINGS

Other features and advantages of the present invention will become apparent from an examination of the succeeding specification when read in conjunction with the appended drawings, which.

DESCRIPTION OF THE PREFERRED EMBODIMENT

Figure 1:
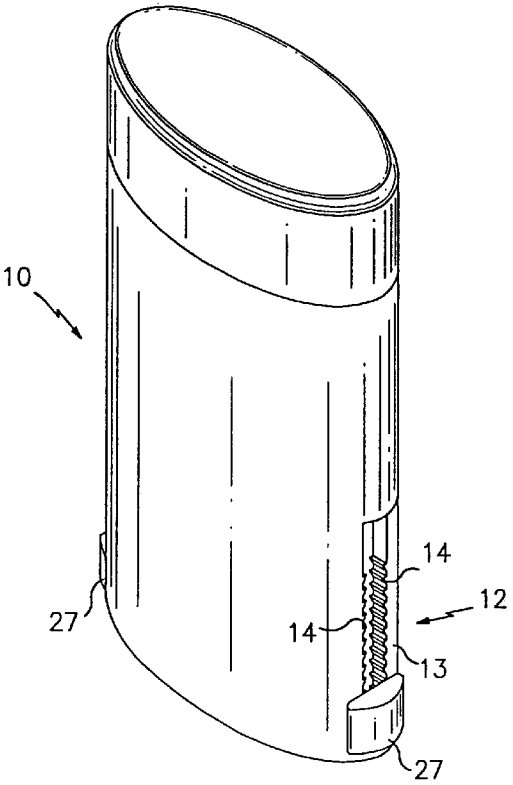
FIG. 1 is a perspective view of a dispenser-applicator embracing principles of the present invention.
Figures 2, 5:
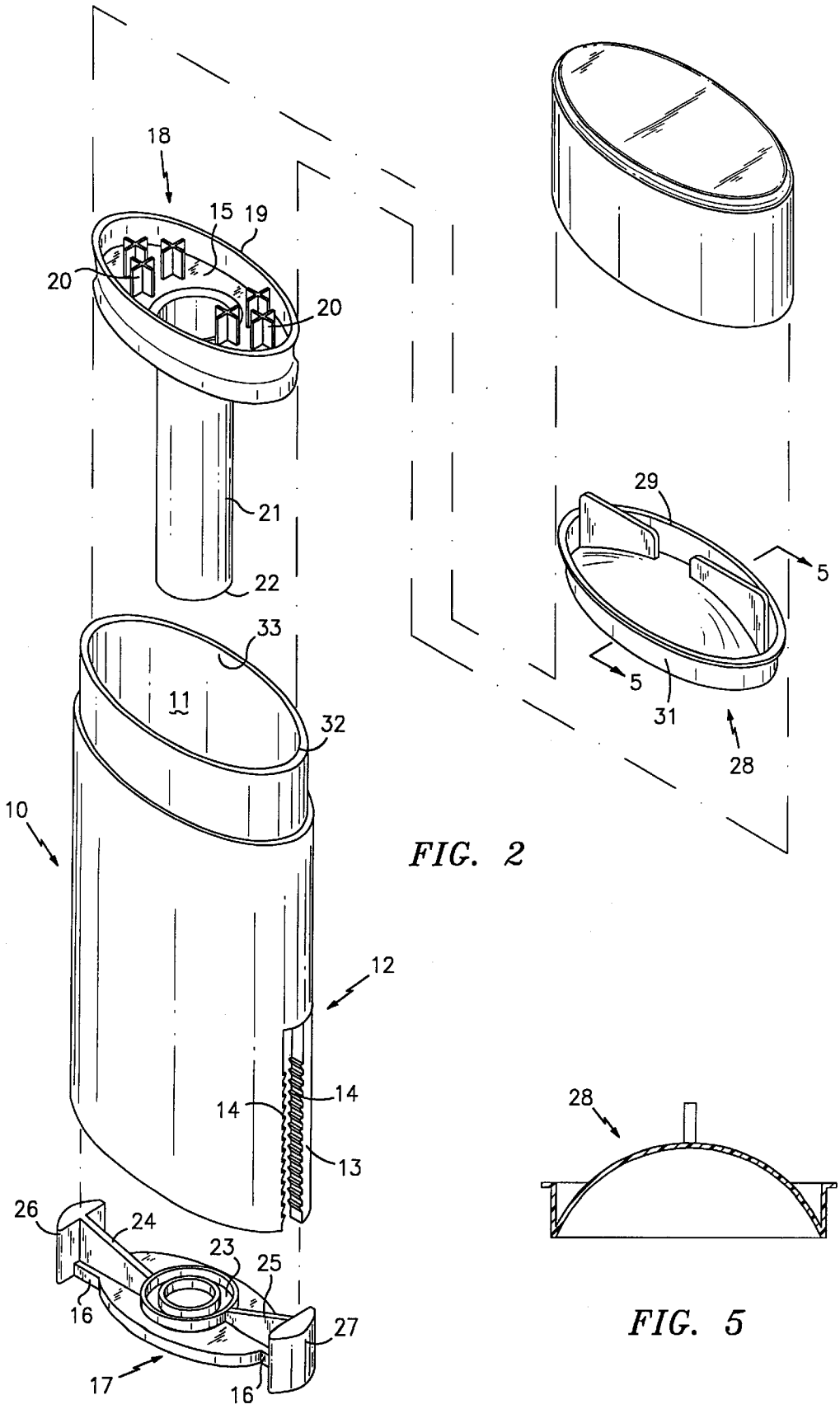
FIG. 2 is an exploded view showing details of the unit of FIG. 1.
FIG. 5 is a vertical section of the first disposable closure taken along the line 5—5 of FIG. 2 to show its internal mold configuration.

Referring to FIGS. 1 and 2 the reference numeral 10 designates a dispenser-applicator having an oval shaped barrel 11 whose sidewall at 12 is formed with opposed slots 13 (only one shown). Opposed sides of each of the slots are formed with linear ratchets 14 engagable with pawls 16 carried by a driver 17.

Disposed in the barrel 11 is an elevator 18 making snug frictional contact with the barrel as the lip 19 thereof engages the internal surface of the barrel. The elevator 18 includes a set of ribs or protuberances 20 for keying product to the elevator. The elevator 18 includes a tubular member 21 which acts dually as a piston rod, supporting the elevator body 15, and as a fill pipe.

The terminal end 22 of the tubular member 21 engages the annulus 23 of driver 17 operable to close the tubular member as the pawls of the driver engage mating ratchets. The driver also serves as a closure for the bottom of the barrel 11.

Ribs 24 and 25 strengthen the overall structure of the driver and support manually operable finger tabs 26 and 27 used to advance a loaded elevator.

First closure 28 is disposable and includes a peripheral rim 29 and a skirt 31 so that the closure 28 is removably received within the barrel as the rim 29 seats upon the top 32 of the barrel as the skirt 31 snugly and frictionally engages the interior of the barrel as at 33.

Note that first closure 28 serves as a product mold and is disposable by user of the dispenser-applicator.

Figure 4:
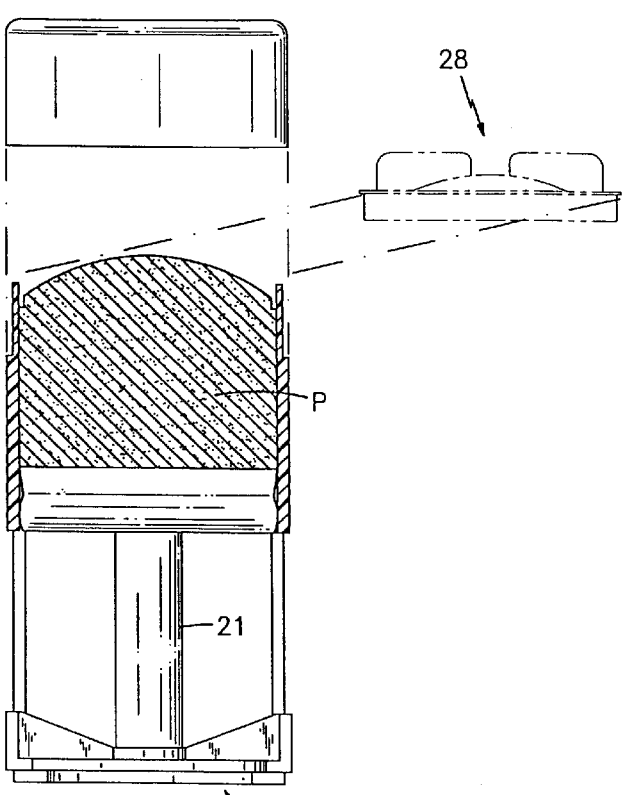
FIG. 4 is a vertical section of the unit of FIG. 1 with the first second closures removed showing the product exposed for the user.
Figure 3:
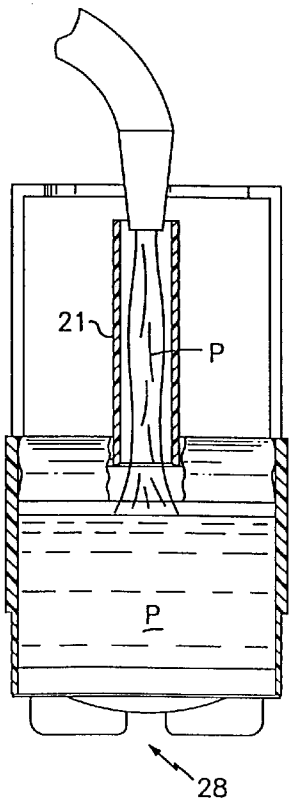
FIG. 3 shows a typical product loading step with the dispenser-applicator inverted.

Referring to FIGS. 3, 4 and 5, the elevator loading step is shown. That is, the barrel, with the elevator snugly in place and the first disposable closure in molding position, is inverted so that warm product P is fed to the elevator via the piston or fill tube 21. After gelling the product is keyed to the elevator by the ribs 20 and the unit is placed in the position shown in FIG. 4.

The customer upon purchase of the dispenser-applicator removes the secondary closure, discards the first disposable closure and is free to apply the product as desired.

As the dome of the product wears or erodes the tabs 26–27—are grasped to advance the driver and thus the elevator to expose the product as necessary.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A dispenser for applying a solid product to a surface, comprising:

a housing having a sidewall, a top open end and a bottom end, said sidewall having opposed slots extending vertically from said bottom end toward said top end;

an elevator slidably disposed in said housing and including a body for supporting product and a tubular fill member extending from said body toward said bottom end of said housing, said tubular fill member terminating away from said body in an open terminal end;

a driver member slidably disposed relative to said housing, said driver member including a driver body and opposed finger tabs, said driver body engaging said open terminal end of said tubular fill member so as to close said open terminal end, and said opposed finger tabs extending from said driver body through said slots of said housing; and wherein said driver body is fixed relative to said open terminal end of said tubular member and slidable with said tubular member relative to said housing.

2. A dispenser for applying a solid product to a surface, comprising:

a barrel having a sidewall, a top open end and a bottom open end, said sidewall having opposed through slots extending vertically from said bottom open end, said slots having opposed ratchet teeth;

an elevator slidably disposed in said barrel and including a body for supporting product and a tubular member having an open terminal end extending from said body toward said bottom open end; and a driver member slidably disposed relative to said barrel and having a driver body engaging said terminal end of said tubular member, opposed finger tabs extending from said driver body through said opposed slots of said barrel, and pawls disposed on said driver body and engaging said opposed ratchet teeth, said driver body, said opposed finger tabs, and said pawls being formed as a single integral element, said driver body being fixed relative to said terminal end of said tubular member and slidable with said tubular member relative to said barrel.

3. A dispenser for applying a solid product to a surface, comprising:

a barrel having a sidewall, a top open end and a bottom open end, said sidewall having opposed through slots extending vertically from said bottom open end, said slots having opposed ratchet teeth;

an elevator slidably disposed in said barrel and including a body for supporting product and a tubular member having an open terminal end extending from said body toward said bottom open end; and a driver member slidably disposed relative to said barrel and having a driver body engaging said terminal end of said tubular member, opposed finger tabs extending from said driver body through said opposed slots of said barrel, pawls disposed on said driver body and engaging said opposed ratchet teeth, and ribs extending between said finger tabs and said driver body for stabilizing said pawls and said finger tabs, said driver body being fixed relative to said terminal end of said tubular member and slidable with said tubular member relative to said barrel.

4. A dispenser according to claim 3, further comprising a first disposable barrel closure comprising a peripheral rim and a depending skirt, said skirt being received within said top open end of said barrel, and said rim being seated on said top open end of said barrel, and a second removable closure overlapping said first disposable closure and engaging an outer edge of said top open end of said barrel.

5. A dispenser according to claim 3, wherein said elevator and said driver member are slidable together relative to said barrel for dispensing product.

6. A dispenser according to claim 3, wherein said driver body, said opposed finger tabs, said pawls and said ribs are formed as a single integral element.

* * * * *